US010161080B2

(12) United States Patent
Jarre et al.

(10) Patent No.: US 10,161,080 B2
(45) Date of Patent: Dec. 25, 2018

(54) VENTILATION INSERT

(71) Applicant: CARL FREUDENBERG KG, Weinheim (DE)

(72) Inventors: Gerald Jarre, Weinheim (DE); Birger Lange, Darmstadt (DE); Volker Braeunling, Heppenheim (DE); Thomas Arnold, Fuerth (DE); Iain Smith, Watchfield (GB); Nermina Zaplatilek, Birkenau (DE); Stephanie Lambertz, Hirschberg (DE); Ulrich Schneider, Darmstadt (DE); Dominic Kramer, Frankfurt (DE)

(73) Assignee: CARL FREUDENBERG KG, Weinheim (DE)

( * ) Notice: Subject to any disclaimer, the term of this patent is extended or adjusted under 35 U.S.C. 154(b) by 177 days.

(21) Appl. No.: 14/772,435

(22) PCT Filed: Mar. 4, 2014

(86) PCT No.: PCT/EP2014/000548
§ 371 (c)(1),
(2) Date: Sep. 3, 2015

(87) PCT Pub. No.: WO2014/135269
PCT Pub. Date: Sep. 12, 2014

(65) Prior Publication Data

US 2016/0010274 A1 Jan. 14, 2016

(30) Foreign Application Priority Data

Mar. 6, 2013 (DE) ..... 10 2013 003 755

(51) Int. Cl.
*D06M 10/02* (2006.01)
*D06M 13/00* (2006.01)
(Continued)

(52) U.S. Cl.
CPC ..... *D06M 15/263* (2013.01); *A41D 27/28* (2013.01); *D06M 10/025* (2013.01);
(Continued)

(58) Field of Classification Search
None
See application file for complete search history.

(56) References Cited

U.S. PATENT DOCUMENTS 3,265,529 A * 8/1966 Caldwell ..... D06M 15/693 428/304.4
3,594,213 A * 7/1971 Rudman ..... D06B 15/085 427/243
(Continued)

FOREIGN PATENT DOCUMENTS

CN 1125391 A 6/1996
CN 1813085 A 8/2006
(Continued)

OTHER PUBLICATIONS

BASF First Quarter Results, Superabsorber fleece keeps your feet dry whatever the weather, Apr. 2009.*
(Continued)

*Primary Examiner* — Jeffrey A Vonch
(74) *Attorney, Agent, or Firm* — Leydig, Voit & Mayer, Ltd.

(57) ABSTRACT

A ventilation insert for textiles, with at least one layer, covered at least partially by an absorption material and having ventilation openings, the openings being at least partially closeable via a liquid by swelling of the absorption material, obtainable by: a) treating a layer having ventilation openings with a mixture, containing a wetting agent, initiator, polymerizable monomer or oligomers, and a cross-linking agent, as a preliminary stage for the absorption material; and b) polymerizing the monomer or oligomer to
(Continued)

form the absorption material while forming a bonded connection between the absorption material and the layer. The ventilation insert has a relatively low thickness, a low weight per unit area, and high flexibility permanently and independently of moisture after economical production, via one layer, self-sealingly closing ventilation openings, and containing the absorption material. The absorption material is connected to the layer by bonding, at least in some regions.

20 Claims, 7 Drawing Sheets

(51) Int. Cl.

| | |
|---|---|
| ***D06M 13/17*** | (2006.01) |
| ***D06M 15/263*** | (2006.01) |
| ***D06M 23/00*** | (2006.01) |
| ***D06M 23/10*** | (2006.01) |
| ***D06M 101/32*** | (2006.01) |
| ***D06M 101/34*** | (2006.01) |
| ***A41D 27/28*** | (2006.01) |
| ***D06M 13/224*** | (2006.01) |
| ***D06N 3/00*** | (2006.01) |
| ***D06M 15/267*** | (2006.01) |
| ***D06M 15/27*** | (2006.01) |
| ***D06M 15/273*** | (2006.01) |
| ***D06M 15/285*** | (2006.01) |
| ***D06M 15/29*** | (2006.01) |
| ***D06M 15/347*** | (2006.01) |
| ***D06M 15/356*** | (2006.01) |
| *A43B 7/08* | (2006.01) |
| *D06M 13/148* | (2006.01) |
| *D06M 13/152* | (2006.01) |
| *D06M 13/292* | (2006.01) |
| *D06M 101/04* | (2006.01) |
| *D06M 101/30* | (2006.01) |
| *D06M 101/18* | (2006.01) |
| *D06M 101/26* | (2006.01) |
| *D06M 101/40* | (2006.01) |
| *D06M 101/00* | (2006.01) |
| *D06M 101/10* | (2006.01) |

(52) U.S. Cl.

CPC ..... *D06M 13/17* (2013.01); *D06M 13/2243* (2013.01); *D06M 15/267* (2013.01); *D06M 15/27* (2013.01); *D06M 15/2735* (2013.01); *D06M 15/285* (2013.01); *D06M 15/29* (2013.01); *D06M 15/347* (2013.01); *D06M 15/3562* (2013.01); *D06M 15/3566* (2013.01); *D06M 23/00* (2013.01); *D06M 23/10* (2013.01); *D06N 3/0059* (2013.01); *A41D 2400/22* (2013.01); *A43B 7/08* (2013.01); *D06M 13/148* (2013.01); *D06M 13/152* (2013.01); *D06M 13/292* (2013.01); *D06M 2101/00* (2013.01); *D06M 2101/04* (2013.01); *D06M 2101/10* (2013.01); *D06M 2101/18* (2013.01); *D06M 2101/26* (2013.01); *D06M 2101/30* (2013.01); *D06M 2101/32* (2013.01); *D06M 2101/34* (2013.01); *D06M 2101/40* (2013.01); *D06M 2200/00* (2013.01); *D06N 2203/041* (2013.01); *D06N 2205/20* (2013.01); *D06N 2205/22* (2013.01); *D06N 2209/121* (2013.01); *D06N 2209/123* (2013.01); *D06N 2209/128* (2013.01); *D06N 2209/148* (2013.01); *D06N 2211/10* (2013.01); *D06N 2211/106* (2013.01); *D06N 2213/045* (2013.01); *Y10S 428/913* (2013.01); *Y10T 428/24322* (2015.01); *Y10T 428/24802* (2015.01); *Y10T 428/249962* (2015.04); *Y10T 428/249964* (2015.04); *Y10T 442/2213* (2015.04); *Y10T 442/2484* (2015.04); *Y10T 442/277* (2015.04); *Y10T 442/2762* (2015.04); *Y10T 442/2779* (2015.04); *Y10T 442/2861* (2015.04); *Y10T 442/2885* (2015.04); *Y10T 442/2926* (2015.04)

(56) References Cited

U.S. PATENT DOCUMENTS 3,632,416 A * 1/1972 Shepherd ..... D06M 14/00 427/2.29
3,940,535 A * 2/1976 Gaeth ..... D04H 1/4334 442/63
4,008,353 A * 2/1977 Gross ..... C08F 8/00 427/385.5
4,036,588 A * 7/1977 Williams ..... C08F 251/02 524/714
4,061,846 A * 12/1977 Gross ..... C08F 8/00 264/216
4,065,598 A * 12/1977 Takahashi ..... D06M 15/263 252/8.61
4,128,692 A * 12/1978 Reid ..... D06M 14/04 427/212
4,176,108 A * 11/1979 Caimi ..... C08F 218/04 427/381
4,235,237 A * 11/1980 Mesek ..... A61F 13/5323 604/368
4,257,768 A 3/1981 Racciato et al.
4,340,057 A * 7/1982 Bloch ..... A61L 15/60 427/501
4,340,706 A * 7/1982 Obayashi ..... C08F 220/06 525/343
4,366,206 A * 12/1982 Tanaka ..... A61C 9/0033 428/364
4,374,175 A * 2/1983 Tanaka ..... A61C 9/0033 428/369
4,600,407 A * 7/1986 Huber ..... D01F 6/18 264/182
4,798,744 A * 1/1989 Goldstein ..... A61L 15/425 427/389.9
4,806,254 A 2/1989 Church
4,837,077 A * 6/1989 Anton ..... G02B 6/4494 427/121
4,865,886 A * 9/1989 Itoh ..... D06M 14/04 427/342
4,867,526 A * 9/1989 Arroyo ..... G02B 6/443 385/107
4,892,754 A * 1/1990 Itoh ..... A61L 15/225 427/391
4,910,250 A * 3/1990 Saotome ..... A61L 15/60 524/556
4,985,298 A * 1/1991 Buckley ..... A61F 13/15203 128/113.1
5,026,780 A * 6/1991 Takizawa ..... C08F 8/44 524/588
5,071,681 A * 12/1991 Manning ..... A61L 15/60 427/392
5,079,034 A * 1/1992 Miyake ..... D06M 14/08 427/348
5,204,175 A * 4/1993 Umeda ..... D06M 15/263 174/107
5,246,770 A * 9/1993 Bottiglione ..... A61L 15/28 442/263
5,298,284 A * 3/1994 Buckwald ..... G02B 6/4494 427/203
5,314,952 A * 5/1994 Choi ..... A61L 15/60 525/119
5,350,370 A 9/1994 Jackson et al.
5,384,370 A * 1/1995 Vondracek ..... A61K 9/2027 525/209

(56) References Cited

U.S. PATENT DOCUMENTS 5,447,788 A * 9/1995 Rhim ..... A61F 13/51403 442/346
5,534,304 A * 7/1996 Geursen ..... D06M 15/263 427/121
5,567,478 A * 10/1996 Houben ..... A61L 15/60 427/342
5,614,269 A * 3/1997 Hoskins ..... B01J 20/26 427/244
5,853,879 A * 12/1998 Takamiya ..... D01F 6/18 428/364
5,925,461 A * 7/1999 Fairgrieve ..... G02B 6/4434 428/372
5,955,187 A * 9/1999 McCormack ..... A61F 13/51403 428/315.5
6,043,311 A * 3/2000 Houben ..... C08F 8/00 524/522
6,087,450 A * 7/2000 Breitbach ..... A61L 15/60 525/242
6,103,317 A * 8/2000 Asai ..... G02B 6/4494 106/14.05
6,143,390 A * 11/2000 Takamiya ..... B01D 53/28 428/88
6,245,410 B1 * 6/2001 Hahnle ..... A61L 15/425 428/132
6,274,231 B1 * 8/2001 Weerkamp ..... D06M 23/04 427/180
6,284,367 B1 * 9/2001 Gruhn ..... D06M 15/263 428/351
6,348,236 B1 * 2/2002 Fairgrieve ..... C09J 7/0217 385/100
6,417,425 B1 * 7/2002 Whitmore ..... A61F 13/15203 427/389.9
6,504,979 B1 * 1/2003 Norris ..... G02B 6/4494 385/109
6,565,981 B1 * 5/2003 Messner ..... A61L 15/60 428/441
6,586,094 B1 * 7/2003 Rebouillat ..... C03C 25/26 385/102
6,635,104 B2 * 10/2003 Komkova ..... B01D 53/22 95/52
6,750,262 B1 * 6/2004 Hahnle ..... A61L 15/24 521/64
6,767,850 B1 * 7/2004 Tebbe ..... A41D 31/0011 428/913
2001/0001794 A1 5/2001 Payet
2001/0047054 A1 * 11/2001 Zopf ..... C08F 220/04 524/815
2002/0137837 A1 * 9/2002 Flautt ..... C08J 7/047 524/522
2003/0113463 A1 * 6/2003 Ko ..... A61L 15/60 427/402
2003/0161995 A1 * 8/2003 Kauschke ..... A61F 13/51403 428/138
2003/0178222 A1 * 9/2003 Moore ..... G02B 6/4494 174/120 R
2003/0211248 A1 * 11/2003 Ko ..... A61F 13/15658 427/385.5
2004/0043688 A1 * 3/2004 Soerens ..... A61F 13/532 442/149
2004/0097895 A1 * 5/2004 Busam ..... A61F 13/15203 604/367
2004/0220350 A1 * 11/2004 Smith ..... C08J 3/12 525/328.2
2004/0232068 A1 * 11/2004 Johnston ..... B01D 39/16 210/502.1
2005/0008776 A1 1/2005 Chhabra et al.
2005/0008839 A1 * 1/2005 Cramer ..... B32B 38/0008 428/221
2005/0031868 A1 * 2/2005 Fossum ..... A61L 15/60 428/375
2005/0043696 A1 * 2/2005 Schmidt ..... A61L 15/60 604/372
2005/0215965 A1 * 9/2005 Schmidt ..... A61F 13/5376 604/358
2006/0014006 A1 * 1/2006 Hermeling ..... A61L 15/60 428/292.1
2006/0178071 A1 * 8/2006 Schmidt ..... A61L 15/26 442/417
2007/0238806 A1 * 10/2007 Mitsukami ..... C08J 3/28 522/150
2008/0057810 A1 * 3/2008 Weber ..... B01J 20/28035 442/121
2008/0057811 A1 3/2008 Yahiaoui et al.
2008/0153371 A1 * 6/2008 Losch ..... C08J 5/10 442/118
2008/0194162 A1 * 8/2008 Herrlich-Loos ..... A61F 13/53 442/64
2008/0214725 A1 * 9/2008 Herrlich-Loos ..... A47C 21/046 524/543
2008/0254263 A1 * 10/2008 Yasui ..... A41D 31/02 428/172
2009/0093585 A1 4/2009 Smith et al.
2009/0203275 A1 8/2009 Dehn
2009/0297756 A1 * 12/2009 Dehn ..... A41D 27/28 428/68
2010/0041291 A1 2/2010 Weber et al.
2010/0042062 A1 * 2/2010 Fernkvist ..... A61F 13/51401 604/361
2010/0119794 A1 * 5/2010 Manstein ..... B01D 46/02 428/219
2011/0061269 A1 * 3/2011 Nakano ..... A43B 7/08 36/3 A
2011/0092636 A1 * 4/2011 Parthiban ..... C08F 8/36 524/548
2012/0036733 A1 2/2012 Dehn
2012/0094566 A1 * 4/2012 Urtel ..... C08F 2/22 442/327
2012/0175556 A1 * 7/2012 Rudolf ..... B32B 5/22 252/194
2012/0209231 A1 8/2012 Rudolf et al.
2013/0059116 A1 * 3/2013 Peikert ..... A43B 7/125 428/138
2013/0143728 A1 * 6/2013 Lyons ..... C09D 133/08 502/4
2014/0331514 A1 11/2014 Dehn

FOREIGN PATENT DOCUMENTS

CN 1844553 A * 10/2006
CN 101410076 A 4/2009
CN 102596393 A 7/2012
CN 102727345 A 10/2012
DE 102006042145 B3 10/2007
DE 102008063229 A1 7/2010
DE 102009009589 A1 9/2010
DE 102009009589 A1 * 9/2010 ..... A43B 7/087
EP 0040087 A2 * 11/1981 ..... A61L 15/60
EP 0223908 A2 * 6/1987 ..... D04H 1/587
EP 1396573 A1 * 3/2004 ..... B32B 27/04
EP 1759605 A2 3/2007
EP 1921939 B1 5/2008
EP 2921939 B1 6/2011
GB 2377939 A * 1/2003 ..... A61F 13/00034
JP 52098064 A * 8/1977
JP 5569632 A 5/1980
JP 55076107 A * 6/1980
JP 61263641 A * 11/1986
JP 62205101 A * 9/1987
JP 63105044 A * 5/1988
JP 646174 A 1/1989
JP 01198346 A * 8/1989
JP 02011690 A * 1/1990
JP 04076064 A * 3/1992
JP 05070762 A * 3/1993
JP 07292142 A * 11/1995
JP 09140404 A * 6/1997 ..... C08F 2/44
JP 2000166606 A * 6/2000 ..... D06B 1/10
JP 2002525451 A 8/2002
JP 2003513625 A 4/2003

(56) References Cited

FOREIGN PATENT DOCUMENTS

| | | | | | |
|---|---|---|---|---|---|
| JP | 2005023431 | A | * | 1/2005 | |
| JP | 2005516130 | A | | 6/2005 | |
| JP | 2009506148 | A | | 2/2009 | |
| JP | 2009506226 | A | | 2/2009 | |
| JP | 2009293153 | A | * | 12/2009 | ..... A43B 7/087 |
| JP | 2011038186 | A | | 2/2011 | |
| WO | WO-9015825 | A1 | * | 12/1990 | ..... C08F 2/44 |
| WO | WO-9743480 | A1 | * | 11/1997 | ..... D06B 1/10 |
| WO | WO-03093567 | A1 | * | 11/2003 | ..... D06M 15/03 |
| WO | WO 2006069689 | A1 | | 7/2006 | |
| WO | WO-2010028749 | A1 | * | 3/2010 | ..... A61F 13/067 |
| WO | WO 2011054784 | A1 | | 5/2011 | |

OTHER PUBLICATIONS

Omidian et al., Swelling and Crosslink Density Measurements for Hydrogels, 1994, Journal of Polymer Science and Technology, vol. 3, No. 2 (Year: 1994).*

Bajpai et al., Synthesis and characterization of a film-forming, crosslinked, amphiphilic block copolymer of butadiene and acrylamide, Feb. 2006, Journal of Polymer Science Part A, vol. 44, Issue 10, pp. 3290-3303 (Year: 2006).*

Elliott, Superabsorbent Polymers, Nov. 1997, BASF (Year: 1997).*

English Abstract for JP 74006194 B, Feb. 1974 (Year: 1974).*

* cited by examiner

VENTILATION INSERT

CROSS-REFERENCE TO RELATED APPLICATIONS

This application is a U.S. national stage application under 35 U.S.C. § 371 of International Application No. PCT/EP2014/000548, filed on Mar. 4, 2014, and claims benefit to German Patent Application No. DE 10 2013 003 755.7, filed on Mar. 6, 2013. The International Application was published in German on Sep. 12, 2014, as WO 2014/135269 A2 under PCT Article 21(2).

FIELD

The invention relates to a ventilation insert for disposition in or on textiles. The invention further relates to a method of forming the ventilation insert and also to its use as moisture and/or microclimate regulator.

BACKGROUND

A ventilation insert of the type referred to at the outset is already known from the prior art. Ventilation inserts of this type typically have a layered construction in two or more plies.

EP 1 921 939 B1 shows a ventilation insert consisting of three plies. One of the plies forms a core element surrounded on both sides by two further functional plies in each case. The two functional plies are connected to each other by adhering or stitching together the two outer edges of the ventilation insert, so the swellable material sits loose and free between the functional plies. The disadvantage with this is that, on mechanically processing, in particular stitching, the ventilation insert, for example in textiles, the swellable material may egress at the needle insertion points because of the lack of fixing.

The core element comprises a swellable material or a vapor absorbent. A binder may bond the core material to either or both of the plies. There is a distinct increase in the basis weight of the ventilation insert on using a binder to fix the swellable material.

A core element disposed between the two functional plies without fixing by means of a binder is free to swell and able to take up a large amount of liquid. There is a distinct increase in the volume and the weight of the core element as a result. A limit is put on the basis weight by the two functional plies, which are spaced apart a certain homogeneous distance.

DE 10 2006 042 145 B3 discloses a ventilation insert consisting of seven plies. Three of the plies form a core element surrounded on both sides by two further functional plies in each case. The core element includes two air-pervious plies which enclose a swellable material. The further functional plies press the air-pervious plies of the core element together in sub-regions to create a chambered structure make up of regular chambers. This is done using functional plies made by injection molding, in which are disposed regularly shaped recesses. The manufacture of such an insert is costly and inconvenient. Not only are appreciable efforts needed to make the functional plies by injection molding, altogether seven plies have to be joined together to make one usable insert.

Owing to their multi-ply construction, the ventilation inserts in the above-described document have considerable size/thickness and also a high basis weight and are stiff and inflexible. This compromises the processing of the ventilation insert, in particular during stitching or adhering, in textiles.

SUMMARY

An aspect of the invention provides a ventilation insert for disposition in or on a textile, the ventilation insert comprising: a ply, which is at least partly covered by an absorbent material and comprises ventilation apertures, wherein exposure of the ply to a liquid can cause at least some of the ventilation apertures to become closed by swelling of the absorbent material, and wherein the ply is obtained a method comprising a) treating the ply including the ventilation apertures with a mixture comprising (i) an absorbent material precursor comprising a polymerizable monomer or oligomer and a crosslinker, (ii) a wetting agent, and (iii) an initiator, and b) polymerizing the monomer or oligomer to form the absorbent material and to form a fusional bond between the absorbent material and the ply, wherein the fusional bond comprises at least regional attachment of the absorbent material to the ply.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
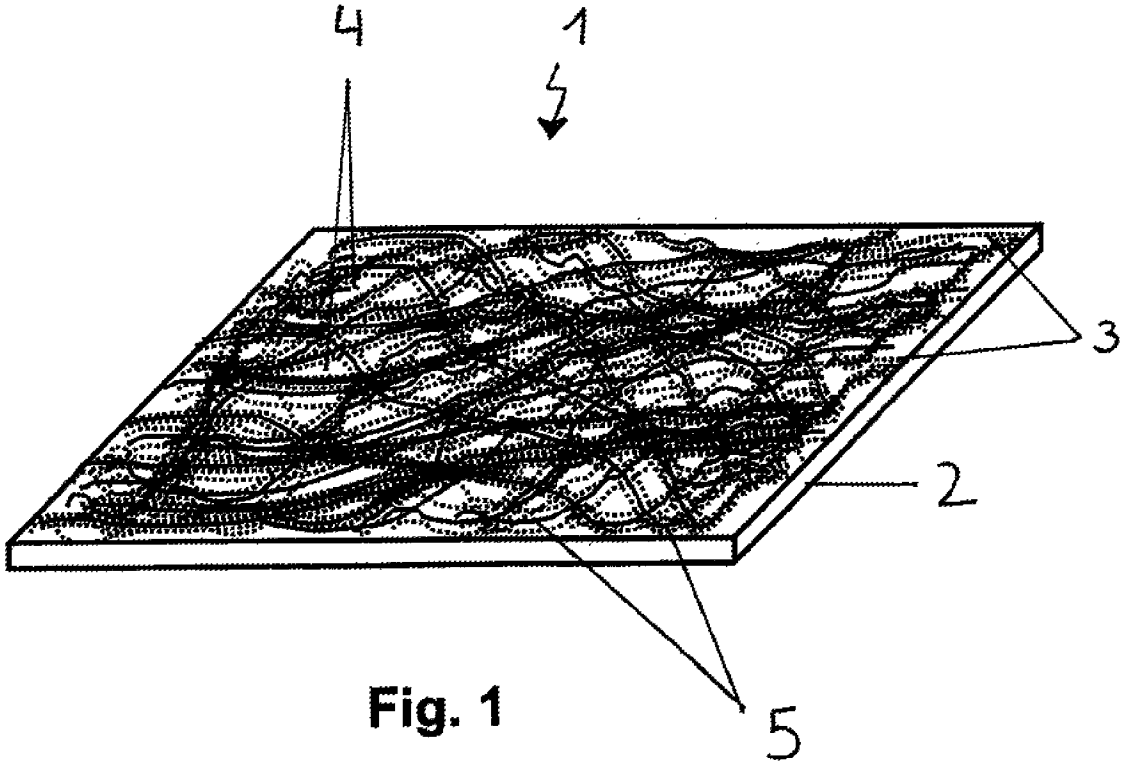
FIG. 1 shows a schematic view of a ventilation insert with complete coverage.

An aspect of the present invention provides a ventilation insert of the type referred to at the outset such that it, following inexpensive fabrication, has permanently a relatively low thickness and a low basis weight coupled with high flexibility, irrespective of moisture/humidity, can be configured as a single ply, closes ventilation apertures self-sealingly and captively contains the absorbent material.

The ventilation insert referred to at the outset is accordingly characterized in that the fusional bond takes the form of at least regional attachment of said absorbent material to the ply.

The inventors recognized that the fusional bonding of the absorbent material within the ply limits the uptake capacity of the absorbent material and renders the ventilation apertures capable of closing self-sealingly. The closing and/or self-sealing comes about because the absorbent material swells to fill up the ventilation apertures completely or partially, sealing them to the passage of liquids and/or gases, preferably to passage of water and/or air.

An absorbent material for the purposes of the present invention is a swellable, preferably liquid-swellable, specifically water-swellable, material which is preferably capable of absorbing not less than about 10 times, in particular about 20 times and preferably about 50 times or more of its own weight in liquid. The absorbent material of the present invention is in principle suitable for absorbing any desired liquids. Preferred liquids are water, aqueous solutions of salt, rainwater, condensation water, blood and/or urine. The absorbent material is preferably insoluble in water.

The fusional bonding disposes the absorbent material captively within the ply. The ply of the present invention is preferably a textile ply. This makes for simple processing of the ventilation insert, in particular during stitching and adhering.

Advantageously, the fusional bonding makes a single-ply construction possible. It is further advantageous that, by virtue of its single-ply construction, the ventilation insert is particularly flexible and supple and also has low thickness.

A further advantage is that the absorbent material stabilizes the ply and no additional reinforcing element is needed.

The absorbent material is preferably employed as binder.

In addition, the ability to vary the amount of absorbent material via the partial/complete coverage of the ply with the absorbent material makes it possible to regulate the liquid absorption capacity of the ventilation insert. As a result, an optimum degree of moisture regulation is attainable with sufficient air circulation and the weight and volume increase is minimizable with suitable adjustment.

Fibers of the ply are preferably coated with the absorbent material to a partial or complete extent. As a result, the absorbent material is applied to the surface of the fibers as a firmly adherent layer. A coating may comprise a thin or thick layer whereby the fiber is completely and coherently encased/enveloped. This provides good adhesion between the absorbent material and the fibers of the ply. The layer thickness of absorbent material is further optimizable.

The problem defined at the outset is solved as a result.

The absorbent material could be coverless; that is, the absorbent material is not covered/encased by a covering ply. This provides for rapid absorption of liquid, since the liquid does not have to pass through the backing or covering ply.

The absorbent material employed according to the present invention is capable on contact with liquid of closing the ventilation apertures by undergoing a change in shape, in particular by undergoing swelling and volume expansion.

The ventilation insert could change/increase in thickness by from 0 to 20 times, preferably by from 2 to 12 times, in particular by from 3 to 10 times, on absorption of liquid. The thickness was determined in accordance with DIN EN 9073-2. This is possible because the ply is able to absorb the liquid homogeneously by virtue of the fusional bonding.

The ply could be incarnated as a batt, as a nonwoven fabric, as a woven fabric, as a weft-knitted fabric produced by weft knitting with independently movable needles, or as a non-crimp fabric. This gives a ventilation insert having a particularly flat construction, and the ventilation insert is easily deformable. This facilitates further processing of the ventilation insert.

It is preferably a nonwoven fabric which is employed according to the present invention. This nonwoven fabric could be mechanically, chemically and/or thermally consolidated. Mechanical consolidation may take the form of needling or of interlacing of fibers of the ply by means of water jets and/or air. This provides a particularly soft product having a low basis weight.

In the case of chemically bonded nonwoven fabrics, a cardweb could be treated with a binder or with the mixture employed to produce the ventilation insert of the present invention by impregnation, spraying or by other customary application techniques.

In a preferred embodiment, the ply contains fibers selected from the group consisting of polyolefin, in particular polyphenylene sulfide, polyester, in particular polyethylene terephthalate, polybutylene terephthalate; polyamide, in particular nylon-6,6 (Nylon®), nylon-6,0 (Perlon®); polyvinyl chloride, polyacrylonitrile, polyimide, polytetrafluoroethylene (Teflon®), aramid, wool, cotton, silk, hemp, bamboo, kenaf, sisal, cellulose, soy, flax, glass, basalt, carbon and viscose fibers and mixtures thereof. Practical tests have shown that a ventilation insert constructed of the aforementioned fibers has a particularly high level of abrasion resistance.

It is particularly preferable for the ply to contain fibers selected from the group consisting of polyethylene, polypropylene, polyamide, poly-p-phenyleneterephthalamide, poly-m-phenyleneterephthalamide, cotton, viscose fibers and mixtures thereof.

In the present invention, the ply has ventilation apertures. The ventilation apertures could be formed by pores present in the ply, specifically by virtue of the fibrous structure. A particularly preferable ply has an ISO 8971-4 porosity in the range from 50 to 95%, in particular in the range from 80 to 90%. It is further conceivable that the ventilation apertures can be introduced by the forming of cutouts and/or openwork. Owing to the ventilation apertures, the absorbent material can expand to a spatially limited extent due to the geometry of the ventilation apertures following liquid absorption and the weight and volume increase of the ventilation insert can be varied.

The ventilation apertures could form a statistical distribution. This makes for rapid absorption of liquid in the ply. Preferably, local absorption of liquid within the ventilation aperture takes place directly at the site of penetration by the liquid.

The ventilation apertures could further have a nonregular geometric construction. This gives rise to capillary effects which lead to very rapid absorption of liquid in the ply.

The ventilation insert could be made thin. To wit, the ventilation insert could have a DIN EN 9073-2 thickness of 20 to 10 000 μm, preferably of 100 to 7000 μm, in particular of 300 to 4000 μm. This makes it possible to employ a custom-tailored ventilation insert for a very wide variety of applications, in particular for applications where available space is limited.

The basis weight may vary between wide limits. The ventilation insert preferably has a DIN EN 29073-1 basis weight of 5 to 600 g/m$^2$, preferably of 30 to 400 g/m$^2$, in particular of 50 to 200 g/m$^2$. Ventilation inserts having such basis weights possess excellent stability.

In a preferred incarnation, the ventilation insert has a DIN ISO 2942 bubble point in the range from 10 to 2500 mbar, preferably in the range from 100 to 1500 mbar, in particular in the range from 500 to 1000 mbar. The bubble point is the pressure needed to force air through the swollen ventilation insert. In ventilation inserts having the aforementioned bubble points, the swelling of the absorbent material ensures very rapid and complete closing of the ventilation apertures. Good sealing takes place against further penetrating liquid.

The ventilation insert could be watertight in a range from 0.1 to 1 bar, preferably from 0.2 to 0.9 bar, in particular from 0.3 to 0.8 bar. To determine watertightness, the permeability to water is determined by the Pfaff method using a water permeameter. Three round samples 12.5 cm in diameter are die-cut out of the ventilation insert of the present invention. The measurements are carried out at a temperature in the range from 18 to 25° C. and at a pressure of 1 bar. The water permeameter is filled via an infill aperture with permeate (water) up to the upper edge of the lining. The sample is then clamped to the water permeameter. To start the measurement, a compressed air valve on the water permeameter is put into the closed position. Now, the compressed air valve is slowly opened. The compressed air valve remains open until the first drops of water pass through the sample. The penetrating drops of water are wiped off on the opposite side of the sample. The compressed air is gradually increased to 0.1 bar within 20 seconds. The water permeability at 0.1 bar is then determined for ten minutes. If no drops of water have managed to get through the sample, the sample is watertight at this pressure. The compressed air is then raised at all times in 0.1 increments in order to determine the pressure at which water passes through the sample. A ventilation insert of this type is notable for rapid closure of the ventilation apertures.

The ventilation insert described herein preferably has a DIN EN ISO 9237 dry state air transmission rate of 100 to 5000 $dm^3/(m^2s)$, more preferably of 400 to 2500 $dm^3/(m^2s)$, in particular of 500 to 1800 $dm^3/(m^2s)$. The air transmission rate was measured before contacting with liquid. Practical tests have shown that, at these values, an effective air exchange takes place and excellent removal of liquid, for example due to perspiration, is effected.

In a preferred embodiment, the absorbent material is chosen such that it is capable of letting go again of the liquid by volume decrease, so that evaporation of the liquid may cause the partly closed ventilation apertures to reopen, preferably at a temperature in the range from −20 to 70° C. and a pressure of 0.1 to 5 bar, in particular at a temperature of −10 to 50° C. and a pressure of 0.3 to 3 bar. The release of liquid preferably takes place automatically without agency of pressure and temperature changes.

The opening and closing of ventilation apertures could be a reversible process. This permits versatile and durable service of the ventilation insert. In addition, the useful life of the ventilation insert is extended.

The ventilation insert could not include any additionally imported hydrophilic fibers. The proportion of hydrophilic additionally imported fibers could be less than 100 wt %, preferably less than 50 wt %, more preferably less than 25 wt %, in particular 0 wt %, all based on the overall weight of the ventilation insert. This permits very fast closure of the ventilation apertures.

The invention also comprehends a method of forming a ventilation insert for disposition in or on textiles, comprising the steps of a) treating a ply having ventilation apertures with a mixture containing a polymerizable monomer or oligomer and a crosslinker as a precursor of an absorbent material, a wetting agent and an initiator, and
b) polymerizing said monomer or oligomer to form said absorbent material and form a fusional bond between said absorbent material and the ply.

It was found that, surprisingly, the use of a wetting agent influences a surface tension of the mixture such that a fusional bond forms between the absorbent material and the ply and the absorbent material becomes captively attached to the ply.

Advantageously, no adhesive, binder and/or adhesion promoter is needed to bond the absorbent material to the ply. An additional step, viz., fixing the absorbent material to the ply, can be eschewed as a result. Thermal fixing of the absorbent material to the ply is also not needed.

The method of the present invention makes it possible to import the absorbent material directly into the ply and attach it thereto. As a result, there is precise control over the liquid absorption and swelling of the absorbent material and there is also self-sealing closure of the ventilation apertures within the ply.

A further advantage of the method according to the present invention is that, owing to the polymerization, the absorbent material has good adherence within the ply and the ventilation insert obtained by the method is notable for an enhanced level of abrasion resistance.

For the purposes of the present invention, a wetting agent is to be understood as meaning natural or synthetic chemistries which, in solution or in mixtures, reduce surface tensions of water or other liquids, so these are better able to penetrate into surfaces of solid bodies, such as the ply, and of saturating and wetting them by displacement of air.

A wetting agent is preferably selected from the group consisting of glycerol, propylene glycol, sorbitol, trihydroxystearin, phenol, acid resin, phospholipids, ethylene oxide-fatty alcohol ether, ethoxylates of propylene oxide with propylene glycol, esters of sorbitol and of glycerol and mixtures thereof.

The wetting agent used is more preferably a compound of the following formula:

$$RO(CH_2CH_2O)_xH,$$

where R is linear or branched alkyl and x is =4, 5, 6.3, 6.5, 7, 8, 9, 10 or 11, preferably 6.5, 7, 8, 9, 10, in particular 6.5, 7, 8, 9. Practical tests have shown that the use of a wetting agent of this type is a particularly effective way to reduce the surface tension of the mixture, facilitating the penetration of the mixture into the ply. This leads to outstanding adherence between the absorbent material and the ply.

Alkyl for the purposes of the present invention is a saturated aliphatic hydrocarbyl group of 1 to 30, preferably 3 to 20, more preferably 4 to 17 and specifically 6 to 11 carbon atoms. Alkyl may be linear or branched and is optionally substituted with one or more aliphatic, specifically saturated, hydrocarbyl groups of 1 to 4 hydrocarbons.

Practical tests have shown that a proportion of the wetting agent in the range from 0.1 to 5 wt %, preferably from 1 to 4 wt % and specifically from 1.5 to 3.5 wt %, all based on the total mixture, makes for particularly uniform and homogeneous wetting of the ply.

Particularly good results regarding the wetting of the ply were obtained on admixing a wetting agent that adjusts the mixture to a DIN 55660 surface tension in the range from 10 to 72 dyn, preferably in the range from 15 to 60 dyn, in particular in the range from 20 to 68 dyn.

Crosslinking comprehends reactions wherein a multiplicity of individual macromolecules become linked to form a three-dimensional network. The linking may be attained either directly in the course of the construction of the macromolecules or by reactions on already extant polymers.

The process of crosslinking may alter the properties of the crosslinked chemistries. The degree of alteration increases with increasing degree of crosslinking. The degree of crosslinking is a quantitative measure to characterize polymeric networks. The degree of crosslinking is computed as quotient formed by dividing the number of moles of crosslinked basic building blocks by the number of moles of all the basic building blocks present in the macromolecular network. The degree of crosslinking is reported either as a dimensionless number or in percent (amount-of-substance fraction).

The crosslinker employed according to the present invention joins/crosslinks the monomers/oligomers to each other in places via chemical bridges. This bridging may reduce the water insolubility of the absorbent material. On ingress of liquid, the absorbent material swells up and causes this network of crosslinks to tauten at a molecular level—the ventilation apertures close self-sealingly. This stops liquid penetrating/passing through the ventilation apertures.

The crosslinker used in the method of the present invention advantageously has two or more reactive functional groups capable of reacting with functional groups of polymerizable monomers or oligomers during the polymerization.

The crosslinker advantageously has at least one olefin, carboxyl and/or carboxylate group. The crosslinkers are preferably selected from the group consisting of:
ethylene glycol bisacrylate, diethylene glycol dimethacrylate, polyethylene glycol dimethacrylate, propylene glycol dimethacrylate, polypropylene glycol dimethacrylate, tetramethylolmethane trimethacrylate, N-methylolacrylamide, glycerol trimethacrylate, glycidyl methacrylate, N,N'-methylenebismethacrylamide, diallyl maleate, diallyl phthalate, diallyl terephthalate, triallyl cyanurate, triallyl isocyanurate, triallyl phosphate, dipentaerythritol hexaacrylate, polyethylene glycol diglycidyl ether, di- or polyglycidyl ethers of aliphatic polyvalent alcohols, ethylene glycol glycidyl ether, myrcenes and mixtures thereof.

Particularly preferred crosslinkers are triethylene glycol dimethacrylate, ethylene dimethacrylate, 1,1,1-trimethylolpropane triacrylate, 1,3,5-triallyl-1,3,5-triazine-2,4,6(1H,3H,5H)-trione, 1,3-butanediol dimethacrylate, 1,4-butanediol dimethacrylate, ethylene glycol dimethacrylate, trimethylolpropane trimethacrylate, N,N'-methylenediacrylamide and mixtures thereof. These crosslinkers are very useful for precisely controlling the uptake capacity of the absorbent material, so only a minimal uptake of liquid is needed to close the ventilation apertures. In consequence the weight of the ventilation insert changes but minimally on uptake of liquid.

In a preferred embodiment, a degree of crosslinking is established in the range from $4.7*10^{-5}$ to $1.9*10^{-1}$, preferably from $2.3*10^{-4}$ to $1.3*10^{-1}$, in particular from $4.7*10^{-4}$ to $4.9*10^{-2}$. A high degree of crosslinking limits the uptake capacity of the absorbent material and causes the ventilation apertures to close on minimal uptake of liquid. There is accordingly scarcely any change in weight on uptake of liquid.

In a preferred embodiment of the invention, the proportion of crosslinker is from 0.01 to 40.00 wt %, preferably from 0.05 to 28.00 wt % and particularly from 0.10 to 20.00 wt %, all based on total monomer. Such a proportion for the crosslinker ensures that the uptake capacity of the absorbent material is high enough to be able to ensure optimum and very fast closure of the ventilation apertures on contact with a liquid.

In a further preferred embodiment, the polymerizable monomer or oligomer is selected from the group consisting of monoethylenically unsaturated monocarboxylic acids, in particular acrylic acid, methacrylic acid, maleic acid, fumaric acid; crotonic acid, sorbic acid, itaconic acid, cinnamic acid; monoethylenically unsaturated polycarboxylic anhydrides, in particular maleic anhydride; carboxylic acid salts, preferably water-soluble salts, in particular alkali metal, ammonium or amine salts; monoethylenically unsaturated mono- or polycarboxylic acids, in particular sodium meth-, trimethylamine meth-, triethanolamine meth-, sodium maleate, methylamine maleate; sulfonic acids, preferably aliphatic or aromatic vinylsulfonic acids, in particular vinyl-, allyl-, vinyltoluene-, styrene-, methacryloylsulfonic acids; 2-hydroxy-3-methacryloyloxypropylsulfonic acid; sulfopropyl methacrylate, sulfonic acid salts, preferably alkali metal, ammonium, amine salts of sulfonated monomers or oligomers; hydroxyl compounds, preferably monoethylenically unsaturated alcohols, monoethylenically unsaturated ethers or esters of polyols, in particular methallyl alcohol, alkylene glycols, glycerol, polyoxyalkylene polyols, hydroxyethyl methacrylate, hydroxypropyl methacrylate, triethylene glycol methacrylate, polyoxy-ethylene-oxypropylene glycol monomethallyl ether, wherein the hydroxyl groups are optionally etherified or esterified; amides, preferably vinylformamide, methacrylamide, N-alkylmethacrylamide, N,N-dialkylmethacrylamide, N-hydroxyalkylmethacrylamide, N-hexylacrylamide, N,N-dimethylacrylamide, N,N'-di-n-propylacrylamide, N-methylolmethacrylamide, N-hydroxyethylmethacrylamide, N,N-dihydroxyethylmethacrylamide, vinyllactams, in particular N-vinylpyrrolidone; amino compounds, preferably amino-containing esters of monoethylenically unsaturated mono- or dicarboxylic acids, heterocyclic vinyl compounds, in particular dialkylaminoalkyl, dihydroxyalkylaminoalkyl or morpholinoalkyl esters; vinylpyridines, in particular 2-vinylpyridine, 4-vinylpyridine, N-vinylpyridine, N-vinylimidazole; quaternary ammonium salts, preferably N,N,N-trialkyl-N-methacryloyloxyalkylammonium salts, in particular N,N,N-trimethyl-N-methacryloyloxyethylammonium chloride, N,N,N-triethyl-N-methacryloyloxy-ethylammonium chloride, 2-hydroxy-3-(meth)acryloyloxypropyltrimethylammonium chloride, in particular dimethylaminoethyl methacrylate, diethylaminoethyl methacrylate, morpholinoethyl methacrylate, dimethylaminoethyl fumarate and mixtures thereof.

The proportion of monomer or oligomer is advantageously from 3 to 80, preferably from 5 to 70 wt %, in particular from 10 to 50 wt %, all based on total mixture. Practical tests have shown that this monomer/oligomer fraction ensures a sufficiently high uptake capacity for the absorbent material, in particular in relation to water, and a particularly stable ventilation insert.

Initiators for the purposes of the present invention are chemistries admixed to the mixture comprising monomers/oligomers and wetting agent in order to facilitate and start/initiate the desired polymerization.

The initiators used are conveniently water-soluble azo compounds; redox systems; peroxycarboxylic acids; peroxycarboxylic esters; thioxanthene; thioamines; ketone peroxides; hydroperoxides; dicarbonates; oxalates; nitriles, preferably valeronitriles; anisoins; benzophenones; acetophenones; anthraquinones; benzenechromium tricarbonyls; benzoins; benzoin ethers; benzils; benzil ketals; 4-benzoylbiphenyls; phenylpropanediols; cumenecyclopentadienyliron(II) hexafluorophosphates; 10,11-dihydro-5H-dibenzo[a,d]cyclohepten-5-ones; diphenyl(2,4,6-trimethylbenzoyl) phosphine oxides; 2-hydroxy-2-methylpropiophenones; 4'-ethoxyacetophenones; ethylanthraquinones; 1-hydroxycyclohexylphenyl ketones, 2-methyl-4'-(methylthio)-2-morpholinopropiophenones, phenanthrenequinones, 4-phenoxyacetophenones; triarylsulfonium hexafluoroantimonates in propylene carbonate; triarylsulfonium hexafluorophosphate salts in propylene carbonate; α-hydroxyketones; phenylglyoxylates; benzyl dimethyl ketals; α-aminoketones; 2,5-dimethyl-2,5-dihydroperoxyhexane; 1,3-di(2-hydroxyperoxyisopropyl)benzene; monoacylphosphines;

bisacylphosphines; phosphine oxides; metallocenes; peroxides; persulfates; permanganates; chlorites; cerium salts; iodine salts and/or hypochlorites; preferably 2,2'-azobis[2-(2-imidazolin-2-yl)propane dihydrochloride; azobis(2-amidinopropane)dihydrochloride; azobiscyanopentanoic acid; 4-benzoyl-N,N,N-trimethylbenzenemethanaminium chloride; 2-hydroxy-3-(4-benzoylphenoxy)-3-N,N,N-trimethyl-1-propanaminium chloride monohydrate; 2-hydroxy-3-(3,4-dimethyl-9-oxo-9H-thioxanthon-2-yloxy)-N,N,N-trimethyl-1-propanaminium chloride; 2-hydroxy-1-[4-(hydroxyethoxy)phenyl]-2-methyl-1-propanone; 2-hydroxy-2-methyl-1-phenylpropan-1-one; 4-benzoyl-N,N-dimethyl-N-[2-(1-oxo-2-propenyl)oxy]ethylbenzenemethanaminium chloride; 1-[4-(2-hydroxyethoxy)phenyl]-2-hydroxy-2-methyl-1-propan-1-one; 2,2'-azobis(4-methoxy-2,4-dimethylvaleronitrile); anthraquinone-2-sulfonic acid sodium monohydrates; bis(2,4,6-trimethylbenzoyl)phenylphosphine oxides; dibenzenechromium; benzoamines; benzoin ethyl ether; benzoin methyl ether; benzoin isobutyl ether; 3,3',4,4'-benzophenonetetracarboxylic dianhydride; 4-phenylbenzophenone; 2-benzyl-2-(dimethylamino)-4'-morpholinobutyrophenone; 4,4'-bis(diethylamino)benzophenone; 4,4'-bis(dimethylamino)benzophenone, 4,4'-dimethylbenzil; 2,5-dimethylbenzophenone; 3,4-dimethylbenzophenone; 3'-hydroxyacetophenone; 4'-hydroxyacetophenone, 3-hydroxybenzophenone; α,α-dimethoxy-α-phenylacetophenone; 4-hydroxybenzophenone; 2-methylbenzophenone; dialkoxyacetophenones; α-hydroxyalkylphenones; α-aminoalkylphenone; 4,4'-dihydroxybenzophenones; 2,2-dimethoxy-2-phenylaceto-phenone; 4-(dimethylamino)benzophenone, 3-methylbenzophenone, 1-hydroxycyclohexyl phenyl ketone; 2-hydroxy-2-methylpropiophenone; 2-hydroxy-2-methylpropiophenone; 4-dimethylaminobenzophenone; 2,2-diethoxy-2-phenylaceto-phenone; 2,2-diethoxyacetophenone; methyl benzoylformate; 2-[2-oxo-2-phenylacetoxyethoxy]ethyl hydroxyphenylacetate; 2-[2-hydroxyethoxy]ethyl hydroxyphenylacrylate; 2-chlorothioxanthen-9-ones; 2-benzyl-2-(dimethylamino)-1-[4-(4-morpholinyl)phenyl]-1-butanone; 2-methyl-1-[4-(4-morpholinyl)phenyl]-1-propanone; diphenyl(2,4,6-trimethyl)benzoylphosphine oxide; phenylbis(2,4,6-trimethyl)benzoylphosphine oxide; ferrocene; titanocene; bis-$\eta^5$-2,4-cyclopentadien-1-yl)bis[2,6-difluoro-3-(1H-pyrro-1-yl)phenyl]titanium; (4-methylphenyl)[4-(2-methylpropyl(4-methylphenyl)[4-(2-methylpropyl)phenyl]iodonium hexafluorophosphate; ammonium persulfate; potassium persulfate; camphorquinone; cumenecyclopentadienyliron hexafluorophosphate; dibenzocycloheptadienone; hydroxyacetophenones; thioxanthen-9-ones; 4,4'-dimethylbenzil; 2-ethylanthraquinone; acryloylphosphine oxide; 2-methyl benzoylformate; didecanoyl peroxide; dilauryl peroxide; dibenzoyl peroxide; di(2-ethyl) peroxydicarbonate; dicyclohexyl peroxydicarbonate; di(4-tert-butyl)cyclohexyl peroxydicarbonate; diacetyl peroxodicarbonate; dimyristyl peroxodicarbonate; di-tert-butyl peroxyoxalate; 2,2-azobis(2,4-dimethylvaleronitrile); 2,2-azobis(4-methoxy-2,4-dimethylvaleronitrile); 2,2'-azobis(2-methylbutyronitrile); 2,2'-azobis(N-(2-propenyl)-2-methylpropionamide; dimethyl 2,2'-azobis(2-methylpropionate); dimethyl 2,2'-azoisobutyrate; 1-hydroxycyclohexyl phenyl ketones; peroxycarboxylic esters formed from pivalic acid, neodecanoic acid, 2-ethylhexanoic acid, tert-butyl hydroperoxide, tert-amyl hydroperoxide and/or cumene hydroxide; tert-amyl hydroperoxide; cumene hydroperoxide; diacyl peroxide; hydrogen peroxide; 2-di(3,5,5-trimethylhexenoyl) peroxide; hydroxyl and/or tert-butyl peroxide, in particular bis(2,4,6-trimethylbenzoyl)phenylphosphine oxides, 1-hydroxycyclohexyl phenyl ketones, benzophenones and/or 1-[4-(2-hydroxyethoxy)phenyl]-2-hydroxy-2-methyl-1-propan-1-ones.

The proportion of initiator could be in the range from 0.1 to 3 wt %, preferably from 0.5 to 2 wt % and particularly from 0.7 to 1.5 wt %, all based on total mixture.

Depending on its field of use, the mixture could contain a filler. Fillers increase the volume or weight and may improve the technical properties of the mixture. The filler is preferably selected from the group consisting of carbonates, in particular calcium carbonate, carbon blacks, in particular conductivity-grade carbon black, graphite, ion exchange resins, activated carbon, silicates, in particular talc, clay, mica, argillaceous earth, chalk, calcium sulfate, barium sulfate, aluminum hydroxide, glass fibers, glass balls and also wood flour, cellulose powder, perlite, granular cork, pelletized plastic, ground thermoplastics, cotton fibers, carbon fibers, in particular ground carbon fibers and mixtures thereof. The admixture of a filler may alter the porosity and the permeability for liquid and/or air.

The mixture could further comprise disinfectants, antioxidants, comonomers, corrosion inhibitors, in particular triazoles and/or benzimidazoles, thickeners, foaming assistants, defoamers, fragrant and/or active ingredients. Practical tests have shown that a biocidal effect is attained by admixture of silver, copper and/or nano particles. To thermoregulate the ventilation insert, the mixture could contain a phase change material (PCM) and/or IR-reflective pigments, preferably paraffin and/or wax capsules. Phase change materials have high heats of fusion for preference and thermal energy is storable in hidden form, losslessly with many repeat cycles for a long period. Bodily or ambient heat can be absorbed, stored and reemitted by phase change materials.

The polymerization of the monomers/oligomers conducted in step b) could result in the formation of a superabsorbent. Superabsorbents are notable for their super ability to bind and imbibe liquid. For the purposes of the present invention, a superabsorbent is a polymer capable of imbibing/absorbing liquids, preferably water, to a multiple—up to 500 times—of its own weight while its volume expands.

To form the mixture, the monomer/oligomer is emulsified or dissolved, preferably in an aqueous solution. The water content of the mixture could be in the range from 20 to 90 wt %, preferably in the range from 30 to 80 wt %, all based on total mixture. When the crosslinker is insoluble, it may be added in emulsified form. A water-miscible organic solvent may additionally be added to dissolve or disperse the crosslinker. The wetting agent and the initiator could be admixed subsequently.

The polymerization preferably takes place in the acidic pH range from 3 to 6, in particular from 4.3 to 5.5. The mixture is particularly stable under these conditions.

The acrylic acid monomer and/or the abovementioned acidic monomers or oligomers could be neutralized using a hydroxide, preferably an alkali metal hydroxide, in particular sodium hydroxide, potassium hydroxide or lithium hydroxide, a carbonate of an alkali metal and/or ammonium hydroxide. Sodium hydroxide and potassium hydroxide are employed with particular preference because of their commercial availability, their cost and their safety.

Treating the ply with the mixture could take the form of impregnating, coating or spraying. The mixture is preferably applied by coating, in particular by blade knife coating or kiss coating. A knife coater typically has a knife scraping against a support, a roll, a tabletop or the substrate itself. So a knife coater is a scraping device. This could be fixed in place across the full width of the web to be coated.

The mixture may be applied using the following knife coaters: knife-over-roll coater, floating knife coater, rubber blanket coater, supported knife coater, table top knife coater, wire-wound knife coater and/or box section knife coater. A kiss coater typically has a smooth-surfaced top roll or a top roll having etched, machined or knurled depressions on the surface. The mixture could be transferred from the top roll to the sheet material to be coated. The depressions may have any desired shape or size and may form a continuous or discontinuous distribution on the surface of the top roll. Application of the mixture by impregnation is particularly preferable, in particular by pad-mangling or by foam impregnation. Pad-mangling is conveniently carried out in one or more steps or stages wherein a precisely defined mixture is applied at an even rate per $m^2$ of textile material. In pad-mangling, a liquor is forced by roll pressure into a woven fabric. The term liquor here comprehends the entirety of all its components, i.e., the solvent, preferably water, as well as any dissolved, emulsified or dispersed constituents—such as dyes, particles, pigments, chemicals and auxiliaries—present therein.

The application rate of the mixture to impregnate, coat or spray the ply may vary between wide limits. Amounts ranging from 10 to 2500 $g/m^2$, in particular from 50 to 1200 $g/m^2$, are typically imported into the fibrous structure of the ply.

After impregnation, coating or spraying, the ply may be squeezed off between two rolls and/or rollers. Practical tests have shown that a squeeze pressure in a range from 1 to 8 bar, preferably from 3 to 5 bar, will ensure optimum establishment of the application rate and a homogeneous distribution of the applied mixture in the fibrous structure of the ply.

The polymerization/curing of the monomers/oligomers could then take place in a subsequent step to form the absorbent material. Depending on the choice of initiator and reaction conditions, the polymerization may be induced autocatalytically, thermally via agency of ionizing radiation or by means of a plasma. The monomer/oligomer is preferably polymerized in the presence of ultraviolet radiation.

UV curing could be effected by using a UV lamp. Radiation intensity and time depend on the composition of the mixture and the constitution of the ply. Particularly good results are obtained at a radiation intensity in the range from 40 to 400 watts/cm, preferably in the range from 100 to 250 watts/cm in the course of a radiation time from 0.1 to 120 seconds. UV curing is conveniently carried out in vacuo or in the presence of an inorganic gas, preferably nitrogen, helium, argon or in air.

Thermal curing could take place in an oven, in air or in an inert atmosphere or in vacuo. It is also conceivable for the applied mixture to polymerize/cure in a dryer, such as a through-air dryer or an infrared dryer. The polymerization/curing typically takes place in the temperature range from 40 to 100° C.

Against this background, electron beam curing is also conceivable for the mixture. The cure typically takes place at an energy dose in the range from 1 to 16 megarad, preferably in the range from 2 to 8 megarad.

After polymerization, impurities could be removed from the ventilation insert by washing. Washing is preferably with water and may be carried out in a continuous or batch manner. It is advantageous here that repeated washing may raise the bubble point of the ventilation insert and also its density. This gives a particularly dense, in particular water-tightly dense, ventilation insert. The ventilation apertures are further rapidly closed by swelling of the absorbent material and the fibrous structure of the ply is optimized.

In a preferred embodiment, the polymerization is followed by a neutralizing step. To this end, the ventilation insert could be led through a neutralizing bath having a pH in the range from 9 to 14, preferably in the range from 10 to 14, in particular in the range from 12 to 14.

Neutralization can be effected using the hydroxides already referred to above, preferably alkali metal hydroxide, in particular sodium hydroxide, potassium hydroxide or lithium hydroxide, carbonate of an alkali metal and/or ammonium hydroxide.

After curing/polymerization, the residual liquid could be removed by further drying in a circulating air oven or with infrared lamps.

In an advantageous embodiment, the surface energy of the ventilation insert is increased by corona and/or plasma treatment. This corona and/or plasma treatment is preferably carried out so as to endow the surface with a DIN 55660 surface energy of 40 to 72 dyn, preferably of 50 to 70 dyn, in particular of 55 to 68 dyn. It is advantageous here that a hydrophilic or hydrophobic finish can be bestowed on the surface without admixture of chemicals. This finish serves to optimally regulate the liquid content of the ventilation insert. This optimum regulation is particularly advantageous in products employed close to the body, as in the case of apparel for example. It is likewise conceivable to provide an antistatic finish to the surface and also reconditioning substances. Against this background, it is also conceivable for the ventilation insert to be subjected to a chemically reactive type of treatment or finish, for example an anti-pilling treatment, a hydrophilicization, an antistatic treatment, a treatment to improve the fire resistance and/or to change the tactile properties or the luster, a mechanical type of treatment such as raising, sanforizing, sanding or a tumbler treatment and/or a treatment to change the appearance such as dyeing or printing.

The ventilation insert of the present invention is by virtue of its low weight, its permeability to air and its high uptake capacity highly suitable for use as moisture regulator. For the purposes of the present invention, a moisture regulator is able to take up moisture from the ambient air and release it back into dry air. The ventilation insert is used with particular preference as moisture regulator in the field of filtration.

On combination with suitable heat-regulating additives, for example a paraffin, IR-reflective pigments or a phase change material (PCM), the ventilation insert could be employed as microclimate regulator. For the purposes of the present invention, a microclimate regulator is a ventilation insert which feels pleasantly cool in hot conditions and is able to warm in cold conditions. It is particularly advantageous for the microclimate regulator to be breathable, i.e., for the ventilation apertures to be large enough to allow the passage of vapors and air, but stop any passage of liquid.

It is also conceivable to use the ventilation insert as a backing material in the manufacture of wound dressings by virtue of its comfortable wearing comfort and its high absorptive capacity.

Further conceivable fields of use for the ventilation insert are for disposition in or on textiles. Preferred textiles are shoes and also shoe soles, sleeping bags, tents, backpacks, bags, jackets, protective suits, gloves, head coverings, preferably as apparel, interlining and/or nonwoven material.

Owing to its pleasant wearing comfort due to good aeration, the ventilation insert could be used with particular preference in or on a shoe.

The ventilation insert could further also be used in protective helmets, goggles, insulating mats, cushioning mats, protectors and also as cosmetic article or packaging material.

The ventilation insert could finally also be used in electronic equipment, electric cables, underwater cables, power cables, window frames, as sealing material and/or as insulating material.

FIG. 1 shows a ventilation insert 1 for disposition in or on textiles comprising at least one ply 2 which is at least partly covered by an absorbent material 3 and has ventilation apertures 4, wherein exposure to a liquid can cause at least some of the said ventilation apertures 4 to become closed by said absorbent material 3 swelling, and obtainable by a method comprising the steps of a) treating a ply 2 having ventilation apertures 4 with a mixture containing a polymerizable monomer or oligomer and a crosslinker as a precursor of said absorbent material, a wetting agent and an initiator, and
b) polymerizing said monomer or oligomer to form said absorbent material 3 and form a fusional bond between said absorbent material 3 and the ply 2.

The fusional bond takes the form of at least regional attachment of said absorbent material 3 to the ply 2.

The ventilation apertures 4 and the sizes of the ventilation apertures 4 form statistically random distributions. The geometry of the ventilation apertures 4 is irregular. The ventilation apertures 4 are not regularly constructed geometric bodies such as cuboids or octahedra, but are open-cell or uninterrupted interspaces separated from each other by fibers 5 and/or the absorbent material 3.

The ply 2 consists of a hydroentangled nonwoven. A hydrophobicizing agent has been provided to this nonwoven to render it hydrophobic. The ply 2 may contain fibers 5 selected from the group consisting of polyolefin, in particular polyphenylene sulfide, polyester, in particular polyethylene terephthalate, polybutylene terephthalate; polyamide, in particular nylon-6,6 (Nylon®), nylon-6,0 (Perlon®); polyvinyl chloride, polyacrylonitrile, polyimide, polytetrafluoroethylene (Teflon®), aramid, wool, cotton, silk, hemp, bamboo, kenaf, sisal, cellulose, soy, flax, glass, basalt, carbon and viscose fibers and mixtures thereof. Ply 2 as depicted in FIG. 1 contains aramid fibers.

The ventilation insert 1 may have a DIN EN 9073-2 thickness of 20 to 10 000 μm, preferably of 100 to 7000 μm, in particular of 300 to 4000 μm. The ventilation insert 1 in FIG. 1 has a thickness of 0.8 mm.

The ventilation insert 1 may have a DIN EN 29073-1 basis weight of 5 to 600 g/m$^2$, preferably of 30 to 400 g/m$^2$, in particular of 50 to 200 g/m$^2$. The ventilation insert 1 depicted in FIG. 1 has a basis weight of 500 g/m$^2$.

The ventilation insert 1 may have a DIN EN ISO 9237 dry state air transmission rate of 100 to 5000 dm$^3$/(m$^2$s), preferably of 400 to 2500 dm$^3$/(m$^2$s), in particular of 500 to 1800 dm$^3$/(m$^2$s). The ventilation insert 1 as per FIG. 1 has an air transmission rate of 1000 dm$^3$/(m$^2$s).

Evaporation of the liquid may cause the partly closed ventilation apertures 4 to reopen, preferably at a temperature in the range from −20 to 70° C. and a pressure of 0.1 to 5 bar, in particular at a temperature of −10 to 50° C. and a pressure of 0.3 to 3 bar. The ventilation insert 1 depicted in FIG. 1 reopens the partially closed ventilation apertures 4 at a temperature of 0° C. and a pressure of 1.013 bar.

The method of forming the ventilation insert 1 for disposition in or on textiles comprises the steps of:

a) treating a ply 2 having ventilation apertures 4 with a mixture containing a polymerizable monomer or oligomer and a crosslinker as a precursor of an absorbent material 3, a wetting agent and an initiator, and
b) polymerizing said monomer or oligomer to form said absorbent material 3 and form a fusional bond between said absorbent material 3 and the ply 2.

The wetting agent used may be a compound of the following formula:

$$RO(CH_2CH_2O)_xH,$$

where R is linear or branched alkyl and x is =4, 5, 6.3, 6.5, 7, 8, 9, 10 or 11, preferably 6.5, 7, 8, 9, 10, in particular 6.5, 7, 8, 9. Wetting agent 1 for forming the ventilation insert depicted in FIG. 1 is a compound of the formula $RO(CH_2CH_2O)_xH$, where R is linear alkyl and x is =6.5.

The proportion of wetting agent may be in the range from 0.1 to 5.0 wt %, preferably from 1.0 to 4.0 wt % and specifically from 1.5 to 3.5 wt %, all based on the total mixture. The proportion of wetting agent to form the ventilation insert 1 depicted in FIG. 1 is 2.0 wt %, based on total mixture.

The wetting agent is admixed to adjust the mixture to a DIN 55660 surface tension in the range from 10 to 72 dyn, preferably in the range from 15 to 60 dyn, in particular in the range from 20 to 68 dyn. The ventilation insert 1 depicted in FIG. 1 has a surface tension of 60 dyn.

A degree of crosslinking may be established in the range from $4.7*10^{-5}$ to $1.9*10^{-1}$, preferably from $2.3*10^{-4}$ to $1.3*10^{-1}$, in particular from $4.7*10^{-4}$ to $4.9*10^{-2}$. The ventilation insert 1 depicted in FIG. 1 has a 0.08 degree of crosslinking.

The polymerizable monomer or oligomer may be selected from the group consisting of monoethylenically unsaturated monocarboxylic acids, in particular acrylic acid, methacrylic acid, maleic acid, fumaric acid; crotonic acid, sorbic acid, itaconic acid, cinnamic acid; monoethylenically unsaturated polycarboxylic anhydrides, in particular maleic anhydride; carboxylic acid salts, preferably water-soluble salts, in particular alkali metal, ammonium or amine salts; monoethylenically unsaturated mono- or polycarboxylic acids, in particular sodium meth-, trimethylamine meth-, triethanolamine meth-, sodium maleate, methylamine maleate; sulfonic acids, preferably aliphatic or aromatic vinylsulfonic acids, in particular vinyl-, allyl-, vinyltoluene-, styrene-, (meth)acryloylsulfonic acids; 2-hydroxy-3-methacryloyloxypropylsulfonic acid; sulfopropyl methacrylate, sulfonic acid salts, preferably alkali metal, ammonium, amine salts of sulfonated monomers or oligomers; hydroxyl compounds, preferably monoethylenically unsaturated alcohols, monoethylenically unsaturated ethers or esters of polyols, in particular methallyl alcohol, alkylene glycols, glycerol, polyoxyalkylene polyols, hydroxyethyl methacrylate, hydroxypropyl methacrylate, triethylene glycol methacrylate, polyoxy-ethyleneoxypropylene glycol monomethallyl ether, wherein the hydroxyl groups are optionally etherified or esterified; amides, preferably vinylformamide, methacrylamide, N-alkylmethacrylamide, N,N-dialkylmethacrylamide, N-hydroxyalkyl(meth)acrylamide, N-hexylacrylamide, N,N-dimethylacrylamide, N,N'-di-n-propylacrylamide, N-methylolmethacrylamide, N-hydroxyethylmethacrylamide, N,N-dihydroxyethylmethacrylamide, vinyllactams, in particular N-vinylpyrrolidone; amino compounds, preferably amino-containing esters of monoethylenically unsaturated mono- or dicarboxylic acids, heterocyclic vinyl compounds, in particular dialkylaminoalkyl, dihydroxyalkylaminoalkyl or morpholinoalkyl esters;

vinylpyridines, in particular 2-vinylpyridine, 4-vinylpyridine, N-vinylpyridine, N-vinylimidazole; quaternary ammonium salts, preferably N,N,N-trialkyl-N-(meth)acryloyloxyalkylammonium salts, in particular N,N,N-trimethyl-N-(meth)acryloyloxyethylammonium chloride, N,N,N-triethyl-N-(meth)acryloyloxy-ethylammonium chloride, 2-hydroxy-3-(meth)acryloyloxypropyltrimethylammonium chloride, in particular dimethylaminoethyl methacrylate, diethylaminoethyl methacrylate, morpholinoethyl methacrylate, dimethylaminoethyl fumarate and mixtures thereof. Acrylic acid is the polymerizable monomer of absorbent 3 for the ventilation insert 1 depicted in FIG. 1.

A superabsorbent is formed by the polymerization in step b).

The surface energy of the ventilation insert 1 is increased by corona and/or plasma treatment. The surface energy of the ventilation insert 1 in FIG. 1 is 70 dyn.

The ventilation insert 1 may be used as moisture and/or microclimate regulator. The ventilation insert 1 shown in FIG. 1 is used as moisture regulator.

Figure 2:
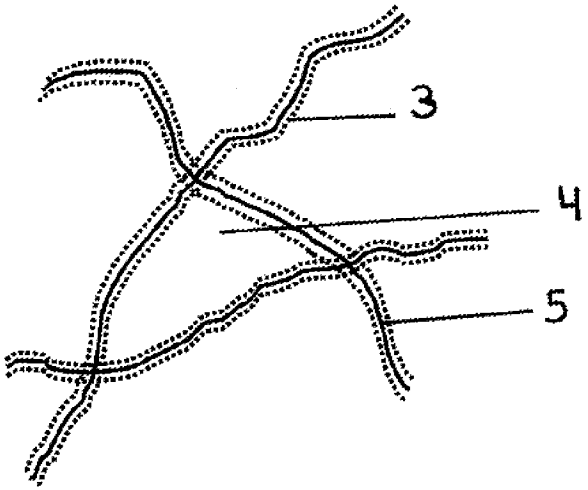
FIG. 2 shows a detailed view of the FIG. 1 ventilation insert in the dry state.

FIG. 2 shows a detailed view in the dry state of ventilation insert 1 as depicted in FIG. 1. This ventilation insert 1 for disposition in or on textiles comprises at least one ply 2 which is at least partly covered by an absorbent material 3 and has ventilation apertures 4, wherein exposure to a liquid can cause at least some of the said ventilation apertures 4 to become closed by said absorbent material 3 swelling. The fusional bond takes the form of at least regional attachment of the absorbent material 3 to the ply 2.

Fibers 5 of ply 2 are completely covered/coated with absorbent material 3.

The ventilation aperture 4 has an octahedral shape, although the ventilation apertures 4 are not constituted by regular geometric shapes.

Ventilation aperture 4 as depicted in FIG. 2 is in the opened state.

Figure 3:
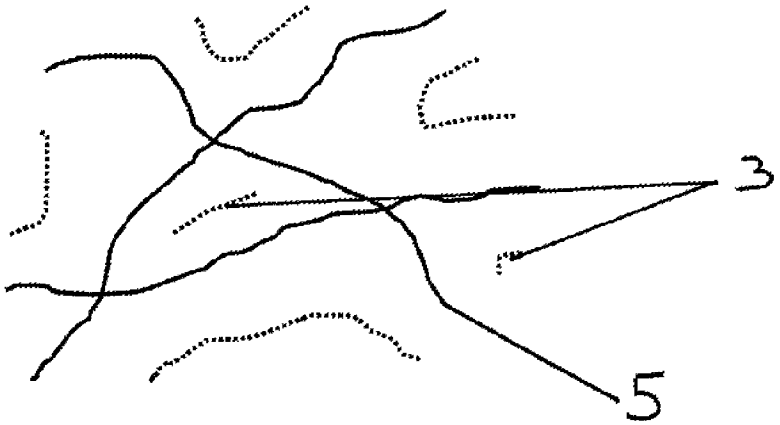
FIG. 3 shows a detailed view of the FIG. 1 ventilation insert under agency of liquid.

FIG. 3 shows a detailed view of ventilation insert 1 as depicted in FIG. 1 under agency of liquid. The penetrating liquid is taken up by the absorbent material 3. The swollen absorbent material 3 completely fills out the ventilation aperture 4, as depicted in FIG. 2, and closes it to the passage of liquid or any gas.

Figure 4:
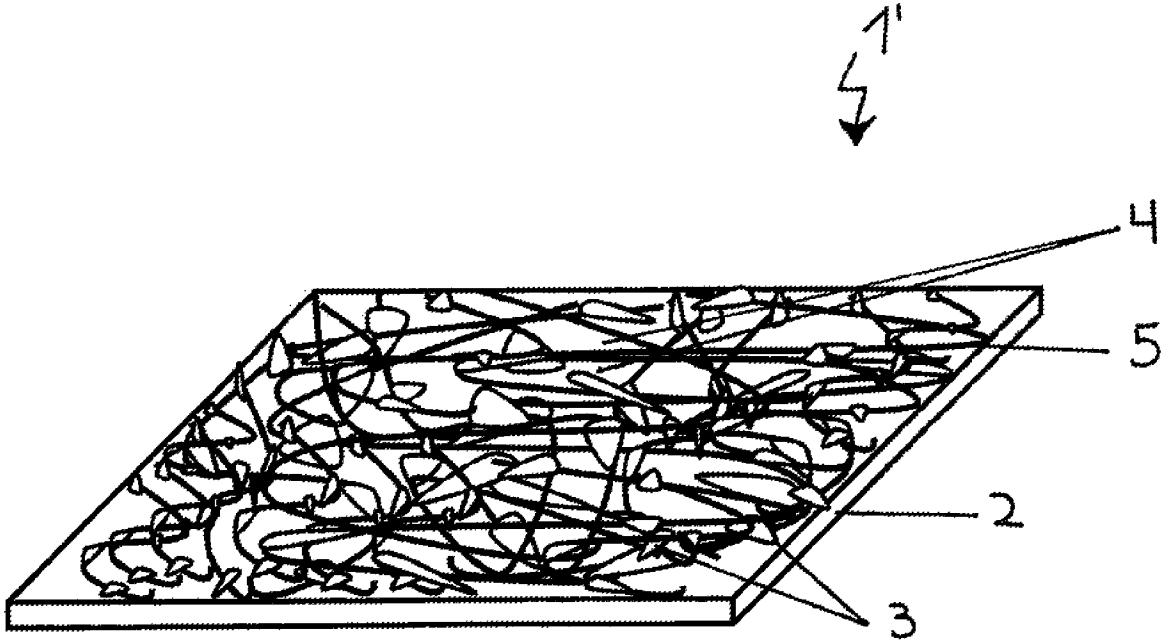
FIG. 4 shows a schematic view of a ventilation insert with partial coverage.

FIG. 4 shows a ventilation insert 1' for disposition in or on textiles, comprising at least one ply 2 which is at least partly covered by an absorbent material 3 and has ventilation apertures 4, wherein exposure to a liquid can cause at least some of the said ventilation apertures 4 to become closed by said absorbent material 3 swelling.

The fusional bond takes the form of at least regional attachment of the absorbent material 3 to the ply 2.

The absorbent material 3 covers the fibers 5 to a partial extent.

The ventilation apertures 4 form a uniform distribution in the ply 2.

The ventilation insert 1', as depicted in FIG. 1, has a basis weight of 100 g/m$^2$.

The ventilation insert 1' as per FIG. 1 has an air transmission rate of 200 dm$^3$/(m$^2$s).

The ventilation insert 1' is formed using the method described above.

Figure 5:
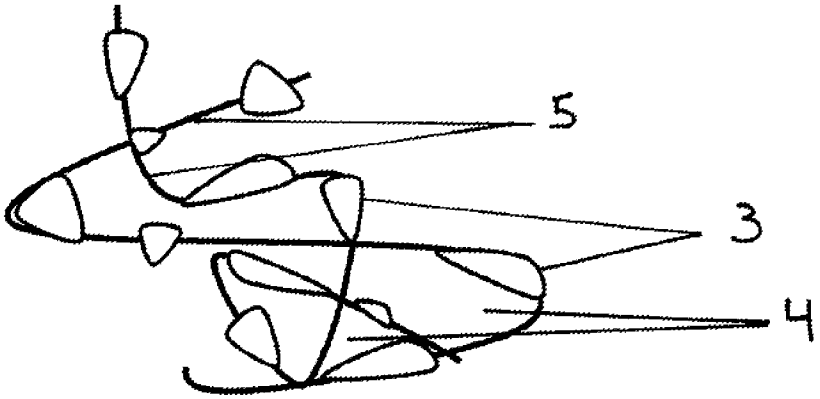
FIG. 5 shows a detailed view of the FIG. 4 ventilation insert in the dry state.

FIG. 5 shows a detailed view of the ventilation insert 1' as depicted in FIG. 4, in the dry state. The fusional bond takes the form of regional attachment of said absorbent material 3 to the fibers 5 of ply 2.

The ventilation apertures 4 are in the opened state.

Figure 6:
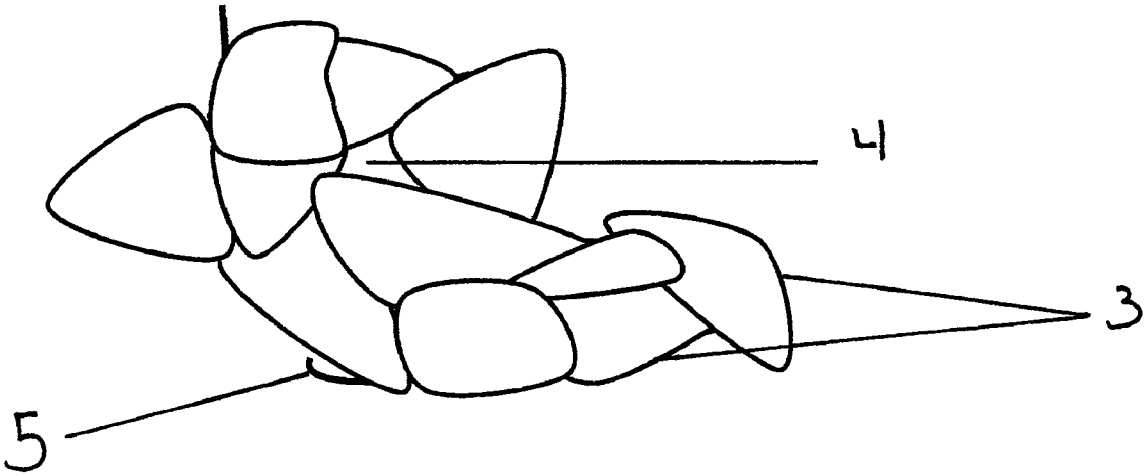
FIG. 6 shows a detailed view of the FIG. 4 ventilation insert under agency of water.

FIG. 6 shows a detailed view of the ventilation insert 1' as depicted in FIG. 4, under agency of water.

The penetrating water is taken up by a volumetrically expanding absorbent material 3. Swelling of the absorbent material 3 results in partial closure of the ventilation aperture 4.

Evaporation of the liquid causes the partly closed ventilation apertures 4 to reopen.

The thickness of the ventilation insert 1' as depicted in FIG. 4 has increased 3-fold under the agency of water.

Figure 7:
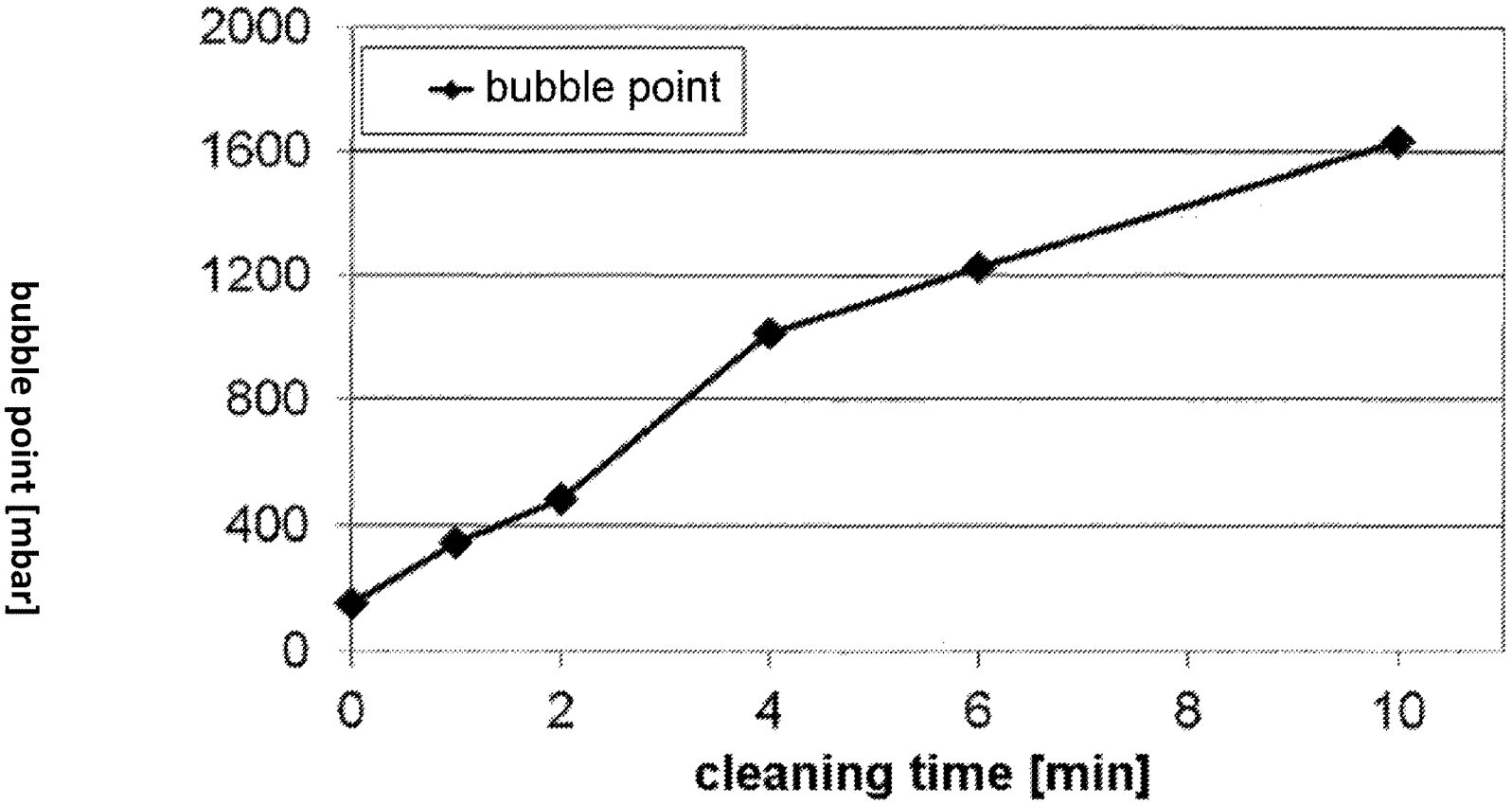
FIG. 7 shows a diagram showing the cleaning time as a function of the bubble point.

FIG. 7 shows a diagram depicting the cleaning time versus the bubble point. The influence of the cleaning time on the bubble point of a ventilation insert was investigated. The measurement of the bubble point was carried out in accordance with DIN ISO 2942. The ventilation insert was formed similarly to working examples 2 and 3. It was determined that the bubble point increases with increasing cleaning time. Cleaning time is the time for washing/cleaning the ventilation insert. The washing/cleaning is preferably with water and serves to remove impurities. This operation may be carried out in a continuous manner or in a batch manner. The ventilation insert may have a DIN ISO 2942 bubble point in the range from 10 to 2500 mbar, preferably in the range from 100 to 1500 mbar, in particular in the range from 500 to 1000 mbar. Even a brief wash raises the DIN ISO 2942 bubble point more than twofold, compared with an unwashed ventilation insert. It was further surprisingly determined that the bubble point is significantly increasable with increasing cleaning time. A bubble point of more than 1000 mbar is attained after a cleaning time of four minutes.

The ventilation insert just described is obtainable according to the following working examples:

Working Example 1

To prepare a partially neutralized acrylic acid solution, 8.00 g of sodium hydroxide are dissolved in 21.00 g of water and admixed with 21.00 g of acrylic acid. Then, 25.00 g of the partially neutralized acrylic acid solution are mixed with 0.50 g of 1-[4-(2-hydroxyethoxy)phenyl]-2-hydroxy-2-methyl-1-propan-1-one, 1.00 g of heptyl polyethylene glycol ether ($C_7H_{15}O(CH_2CH_2O)_{6.5}H$) and 47.00 g of water until homogeneous. The pH of the solution is about 4.

The solution is admixed with 0.25 g of N,N'-methylenediacrylamide and stirred at a temperature of about 22° C. for 15 minutes. The solution obtained is placed in a pad-mangle at 20° C. A 10×10 cm polyethylene terephthalate batt having a basis weight of 100 g/cm$^2$ is then introduced and pulled through the pad-mangle (Sawafill 1122, from Sandler). 280 g/m$^2$ are imported into the fiber structure of the ply.

The impregnated batt is squeezed off between two rollers and subjected to a UV treatment to start the polymerization of a mixture comprising acrylic acid, a crosslinker, a wetting agent and an initiator. The UV treatment is effected by switching on UV radiators (Uvahand 250 from Dr. Hönle, 250 watts per radiator). The irradiation time is 10 seconds. The degree of crosslinking of the absorbent material is 0.011. The irradiated batt is washed with water and dried at 70° C. for four hours.

After polymerization, the weight of the batt increases by about 70 wt %. The swelling rate defines the amount of water absorbed by the coating within a fixed time interval. The swelling power refers to the maximum amount of water or liquid absorbed by the coating and is based on the dry weight of the coating.

The swelling rate is determined by measuring the percentage swell or the weight increase in time intervals from 0 to 20 minutes.

The swelling rate is 60.00 and the weight after swelling is 43.44 g.

The thickness of the ventilation insert formed in Working Example 1 is 0.1 mm.

Working Example 2

To prepare a partially neutralized methacrylic acid solution, 8.00 g of sodium hydroxide are dissolved in 12.00 g of water and admixed with 30.00 g of methacrylic acid. Then, 30.00 g of the partially neutralized methacrylic acid solution are mixed with 0.95 g of bis(2,4,6-trimethylbenzoyl)phenylphosphine oxide, 0.95 g of octyl polyethylene glycol ether ($C_8H_{17}O(CH_2CH_2O)_9H$) and 63.10 g of water until homogeneous. The pH of the solution is about 3.5.

The solution is admixed with 0.32 g of 1,3,5-triallyl-1,3,5-triazine-2,4,6(1H,3H,5H)-trione and stirred at a temperature of about 22° C. for 15 minutes. A 10×10 cm polyamide batt having a basis weight of 200 g/cm$^2$ is then drenched with the solution. 1000 g/m$^2$ are imported into the fiber structure of the ply.

The impregnated batt is squeezed off between two rollers and subjected to a UV treatment to start the polymerization of a mixture comprising acrylic acid, a crosslinker, a wetting agent and an initiator. The UV treatment is effected by switching on UV radiators (Uvahand 250 from Dr. Hönle, 250 watts per radiator). The irradiation time is 20 seconds. The degree of crosslinking of the absorbent material is 0.007. The irradiated batt is washed with water and dried at 70° C. for four hours.

After polymerization, the weight of the batt increases by about 80 wt %.

The swelling rate is determined by measuring the percentage swell or the weight increase in time intervals from 0 to 20 minutes.

The swelling rate is 50.00 and the weight after swelling is 39.93 g.

The thickness of the ventilation insert formed in Working Example 2 is 1.5 mm.

Working Example 3

To prepare a partially neutralized vinylsulfonic acid solution, 5.00 g of potassium hydroxide are dissolved in 20.00 g of water and admixed with 15.00 g of vinylsulfonic acid. Then, 15.00 g of the partially neutralized vinylsulfonic acid solution are mixed with 0.5 g of 1-hydroxycyclohexyl phenyl ketone, 0.5 g of benzophenone, 1.50 g of ethyl polyethylene glycol ether ($C_2H_5O(CH_2CH_2O)_{6.5}H$) and 32.50 g of water until homogenous. The pH of the solution is about 3.5.

The solution is admixed with 0.15 g of ethylene glycol dimethacrylate and stirred at a temperature of about 22° C. for 15 minutes. A 10×10 cm viscose batt having a basis weight of 300 g/cm$^2$ is then drenched with the solution. 2200 g/m$^2$ are imported into the fiber structure of the ply.

The impregnated batt is squeezed off between two rollers and subjected to a UV treatment to start the polymerization of a mixture comprising acrylic acid, a crosslinker, a wetting agent and an initiator. The UV treatment is effected by switching on UV radiators (Uvahand 250 from Dr. Hönle, 250 watts per radiator). The irradiation time is 13 seconds. The degree of crosslinking of the absorbent material is 0.016. The irradiated batt is washed with water and dried at 70° C. for four hours.

Working Example 4

The influence of washing and of cleaning time on the bubble point was investigated. To this end, samples of a ventilation insert were washed with water for different times after polymerization. This was followed by a bubble point test in accordance with DIN ISO 2942. The in-test ventilation insert was dipped at about 20° C. into a water-filled container for two minutes. For this, the ventilation insert was completely wetted with liquid. The ventilation insert was subsequently subjected to compressed air. A measurement was then carried out to determine the pressure needed to force air through the ventilation insert and/or the ventilation apertures.

The table which follows shows the bubble points as a function of cleaning time:

TABLE 1

Experimentally determined bubble points of inventive ventilation insert at different cleaning times.

| Sample | Cleaning time [min] | Bubble point [mbar] |
|---|---|---|
| 1 | 0 | 150 |
| 2 | 1 | 345 |
| 3 | 2 | 483 |
| 4 | 4 | 1013 |
| 5 | 6 | 1226 |
| 6 | 10 | 1634 |

The experiments show that the ventilation insert of the present invention has high bubble points. It was further determined that, surprisingly, a single wash of the ventilation insert after polymerization is sufficient to achieve a distinct increase in the bubble point. The bubble point is further increasable with increasing cleaning time.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A ventilation insert for deposition in or on a textile, the ventilation insert comprising:

a ply, which is at least partly covered by an absorbent material having a cross-linking degree from $4.7\times10^{-5}$ to $1.9\times10^{-1}$ and comprising ventilation apertures, wherein the exposure of the ply to a liquid causes at least some of the ventilation apertures to close by swelling of the absorbent material and evaporation of the liquid causes the closed ventilation apertures to reopen; and wherein the ply is obtained by a method comprising a) treating the ply including the ventilation apertures with a mixture comprising (i) an absorbent material precursor comprising polymerizable monomers or oligomers and a crosslinker, (ii) a wetting agent, and (iii) an initiator, wherein the wetting agent is admixed to adjust a DIN 55660 surface tension of the mixture to a range from 10 to 72 dyn, and b) polymerizing the monomers or oligomers to form the absorbent material and to form a fusional bond between the absorbent material and the ply, wherein the fusional bond comprises at least a regional attachment of the absorbent material to the ply.

2. The ventilation insert of claim 1, wherein the polymerizing comprises forming a superabsorbent.

3. The ventilation insert of claim 1, wherein the ply comprises fibers comprising polyolefin, polyester, polyamide, polyvinyl chloride, polyacrylonitrile, polyimide, polytetrafluoroethylene, aramid, wool, cotton, silk, hemp, bamboo, kenaf, sisal, cellulose, soy, flax, glass, basalt, carbon, viscose, or two or more of any of these.

4. The ventilation insert of claim 1, wherein the ply comprises fibers comprising polyphenylene sulfide, polyethylene terephthalate, polybutylene terephthalate, nylon-6,6, nylon-6,0, or two or more of any of these.

5. The ventilation insert of claim 1, wherein the polymerizable monomer or oligomer comprises a monoethylenically unsaturated monocarboxylic acid, monoethylenically unsaturated polycarboxylic anhydride, carboxylic acid salt, monoethylenically unsaturated polycarboxylic acid, sulfonic acid, sulfonic acid salt, hydroxyl compound, monoethylenically unsaturated ether of polyol, monoethylenically unsaturated ester of polyol, amide, vinyllactams, amino compound, heterocyclic vinyl compound, or a mixture of two or more of any of these.

6. The ventilation insert of claim 1, comprising the crosslinker from 0.01 to 40 wt %, based on the total monomer.

7. The ventilation insert of claim 1, wherein the crosslinker is selected from ethylene glycol bisacrylate, diethylene glycol dimethacrylate, polyethylene glycol dimethacrylate, propylene glycol dimethacrylate, polypropylene glycol dimethacrylate, tetramethylolmethane trimethacrylate, methylolacrylamide, glycerol trimethacrylate, glycidyl methacrylate, N',N'-methylenebismethacrylamide, diallyl maleate, diallyl phthalate, diallyl terephthalate, triallyl cyanurate, triallyl isocyanurate, triallyl phosphate, dipentaerythritol hexaacrylate, polyethylene glycol diglycidyl ether, di- or polyglycidyl ethers of aliphatic polyvalent alcohols, ethylene glycol glycidyl ether, myrcenes, and mixtures thereof.

8. The ventilation insert of claim 1, comprising the wetting agent from 0.1 to 5 wt %, based on the total mixture.

9. The ventilation insert of claim 1, wherein the wetting agent is selected from glycerol, propylene glycol, sorbitol, trihydroxystearin, phenol, acid resin, phospholipids, ethylene oxide-fatty alcohol ethers, ethoxylates of propylene oxide with propylene glycol, esters of sorbitol, esters of glycerol, and mixtures thereof.

10. The ventilation insert of claim 9, wherein the wetting agent is a compound of the formula:

$$RO(CH_2CH_2O)_xH$$

wherein

R is a linear or branched alkyl, and x is 4, 5, 6.3, 6.5, 7, 8, 9, 10, or 11.

11. The ventilation insert of claim 1, wherein the initiator comprises an initiator which facilitates polymerization in the presence of ultraviolet radiation.

12. The ventilation insert of claim 1, having a DIN EN 9073-2 thickness of 20 to 10000 μm.

13. The ventilation insert of claim 12, having a DIN EN 9073-2 thickness of 100 to 7000 μm.

14. The ventilation insert of claim 13, having a DIN EN 9073-2 thickness of 300 to 4000 μm.

15. The ventilation insert of claim 1, having a DIN EN 29073-1 basis weight of 5 to 600 $g/m^2$.

16. The ventilation insert of claim 15, having a DIN EN 29073-1 basis weight of 30 to 400 $g/m^2$.

17. The ventilation insert of claim 1, having a DIN EN 29073-1 basis weight of 50 to 200 $g/m^2$.

18. The ventilation insert of claim 1, having a DIN EN ISO 9237 dry state air transmission rate of 100 to 5000 $dm^3/(m^2s)$.

19. The ventilation insert of claim 1, wherein the method further comprises corona and/or plasma treating the ventilation insert to increase a surface energy of the ventilation insert.

20. A moisture and/or microclimate regulator, comprising the ventilation insert of claim 1.

* * * * *